US006371336B1

(12) United States Patent
Keller

(10) Patent No.: US 6,371,336 B1
(45) Date of Patent: Apr. 16, 2002

(54) ELECTRICALLY OPERATED CARTRIDGE DISPENSING APPLIANCE

(76) Inventor: Wilhelm A. Keller, Obstgartenweg 9, CH-6402 Merlischachen (CH)

( * ) Notice: Subject to any disclaimer, the term of this patent is extended or adjusted under 35 U.S.C. 154(b) by 0 days.

(21) Appl. No.: 09/705,935

(22) Filed: Nov. 6, 2000

(30) Foreign Application Priority Data

Nov. 16, 1999 (CH) ..... 2081/99

(51) Int. Cl.[7] ..... B65D 88/54

(52) U.S. Cl. ..... 222/333; 222/390; 192/48.2; 192/48.91; 474/59; 474/66

(58) Field of Search ..... 222/390, 333, 222/137; 474/158, 159, 59, 66, 85; 192/48.91, 48.2

(56) References Cited

U.S. PATENT DOCUMENTS

| | | | | |
|---|---|---|---|---|
| 3,387,689 A | * | 6/1968 | Ovshinsky | 192/4 |
| 4,180,187 A | | 12/1979 | Ben-Haim | 222/326 |
| 5,203,476 A | | 4/1993 | Keller | 222/136 |
| 5,286,105 A | | 2/1994 | Herold et al. | 366/177 |
| 5,464,128 A | | 11/1995 | Keller | 222/333 |
| 6,168,052 B1 | | 1/2001 | Keller | 222/333 |

FOREIGN PATENT DOCUMENTS

| | | |
|---|---|---|
| EP | 0 492 413 | 7/1992 |

* cited by examiner

*Primary Examiner*—Lesley D. Morris
*Assistant Examiner*—M A Cartagena
(74) *Attorney, Agent, or Firm*—Foley & Lardner

(57) ABSTRACT

The electrically operated dispensing appliance comprises a gear motor which is connected to the main shaft by a first gear and a first shifting sleeve in order to operate the advance and the relieving stroke under high loads, and for the operation at smaller loads, i.e. fast retraction and fast forward feed, it is connected to the main shaft by a second gear, a driving shaft, and a second shifting sleeve. An electromagnet is connected to said two shifting sleeves in such a manner that one or the other shifting sleeve is selectively connectable to the main shaft. A drive assembly of this kind is more economical and more silent than a solution with two gear motors.

10 Claims, 6 Drawing Sheets

ELECTRICALLY OPERATED CARTRIDGE DISPENSING APPLIANCE

BACKGROUND OF THE INVENTION

1. Field of the Invention

The present invention refers to an electrically operated dispensing appliance in which the electromechanical drive assembly comprises a motor actuating at least one driving screw for the slow advance and the relieving stroke as well as coupling means allowing to switch to fast retraction and fast forward feed.

High pressure forces are required in order to press the compositions contained in containers or cartridges through a mixing device, e.g. a static mixer, and the cartridges, which are generally made of synthetic materials, are expanded by the resulting load. This cartridge pressure must be instantly relieved as soon as the dispensing stops, or else the compositions will continue to flow out of the mixer, the so-called afterflow. To prevent this, the thrust members are capable of performing a small relieving stroke just after the dispensing motion. It is further required that the retraction of the drive assembly or the forward feed of the thrust members into a partly dispensed cartridge be effected substantially faster than the dispensing motion itself.

2. Description of the Prior Art

U.S. Pat. No. 5,203,476 takes this problem into account by effecting the relieving stroke through a mechanical axial displacement of the driving screws by means of a toggle joint. According to U.S. Pat. No. 5,464,128, both the relieving stroke and the fast retraction are effected by a second motor and corresponding magnetic couplings.

It is further known from European Patent No. 0,492,413 to use a magnet coupling in order to disengage the advance drive from a chain driven thrust slide to allow a certain cartridge relief and a manual retraction. In this case, the fast forward feed is effected manually by means of a handle.

In the electrically operated dispensing appliances of the prior art discussed above, the electric drive has several drawbacks. These drawbacks have been eliminated by a drive disclosed in the co-pending U.S. application Ser. No. 09/310,919, where two motors are used in order to operate the dispensing motion and the relieving stroke, on one hand, and the fast forward feed and the fast retraction, on the other hand. It has been found that this concept can be improved, so as to save the costs for the second motor, in particular, and to reduce the noise caused by the second motor.

Electrically operated dispensing appliances are already known from the previously mentioned U.S. Pat. Nos. 5,203,476 and 5,464,128 to the same Applicant. These appliances are essentially so designed that a driving screw advances a slide to which two thrust rods are fastened, and the compositions are dispensed by means of two cartridge pistons.

In another known appliance according to European Patent No. 0,492,413, the slide is advanced by two laterally disposed chains and, in another case, by toothed racks. These known devices have fundamental disadvantages. The different reaction forces that are generated at different dispensing ratios load the thrust rods with high torque and cause important canting friction and deformation forces on the guiding bridge and on the necessary guiding elements, whereby such appliances are expensive in construction and difficult to lubricate and seal.

In other cases, e.g. according to U.S. Pat. No. 4,180,187, where the driving screws must be lubricated due to the high dispensing forces are directly introduced into the cartridges, these driving members are subject to soiling and difficult to clean if soiled by the dispensed component materials, which is impractical for the user. If the guiding bridge is axially moved by means of chains, an essential drawback is that the very slow dispensing speed requires a gear having a high reduction ratio as well as a very costly high torque magnet coupling allowing to uncouple the drive unit for the relieving stroke and retraction.

SUMMARY OF THE INVENTION

On the background of this prior art, it is the object of the present invention to eliminate the drawbacks discussed above and to provide an economical and silent drive assembly. This object is attained by an electric drive assembly wherein a gear motor is connected to the main shaft by a first gear and a first shifting sleeve in order to operate the advance and the relieving stroke at high loads, whereas for the operation at smaller loads, i.e. fast retraction and fast forward feed, it is connected to the main shaft by a second gear, a driving shaft, and a second shifting sleeve, and wherein an electromagnet is connected to said two shifting sleeves in such a manner that one or the other shifting sleeve is selectively connectable to the main shaft.

The dependent claims refer to developments of the electric drive assembly of the invention and also to an advance unit which is used as a mechanical structural assembly in dispensing appliances for multiple component compositions.

BRIEF DESCRIPTION OF THE DRAWINGS

The invention shall be explained in more detail hereinafter with reference to drawings of embodiments.

DETAILED DESCRIPTION OF THE INVENTION

Figure 1:
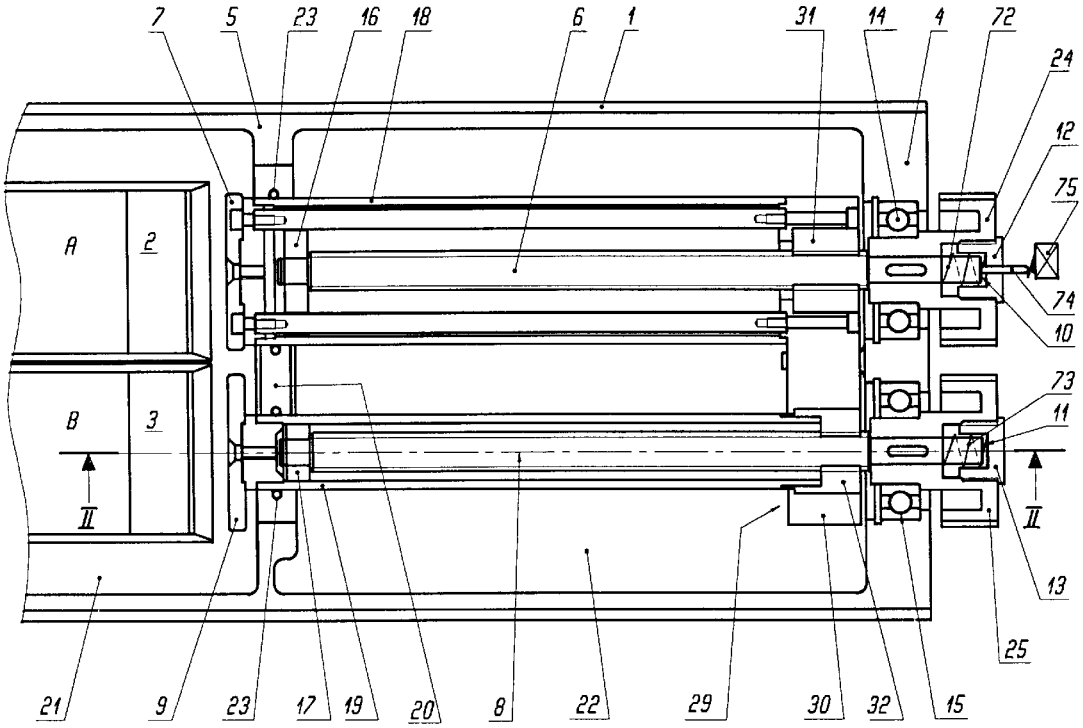
FIG. 1 shows a sectional view according to line I—I in FIG. 3 of a first embodiment of an advance unit of the invention in a dispensing appliance.

FIG. 1 shows the frame 1 of the dispensing appliance and on the cartridge side, i.e. on the front side, a cartridge A with piston 2 and a cartridge B with piston 3. On the drive side, i.e. at the back, frame 1 comprises a rear closure wall 4 and on the cartridge side, a wall 5; the drive assembly being journalled and guided within these two frame parts. The advance unit comprises a first driving screw 6 including a first thrust plate 7 for cartridge A and a second driving screw 8 including thrust plate 9 for cartridge B. Both driving screws are rigidly disposed in the axial direction; they are axially and radially journalled and supported on the rear closure wall 4 by bearing surfaces 10 and 11 of support bushings 12 and 13 which are mounted in ball or thrust bearings 14 and 15.

On the front side, the driving screws are radially journalled on guiding pistons 16 and 17 which in turn are journalled in ram tubes 18 and 19, the ram tubes being guided in wall 5 by a common first guide 20.

Cartridge space 21 is sealed against drive space 22 by sealing elements 23. The driving screws are synchronously driven by toothed belt wheels 24 and 25 through a toothed belt 26 actuated by a toothed belt wheel 28 on shaft 27, see FIG. 3.

The movement advances the guiding bridge 29 that consists of a second guide 30 comprising the two screw sockets 31, 32, ram tubes 18, 19 and thrust plates 7, 9, thereby pressing the dispensed media through the mixer by means of the thrust plates and the cartridge pistons. The second guide and the thrust plate on cartridge side A are screwed together by connecting rods and screws in such a manner that the contact pressure is fully absorbed by the ram tube. The ram tube on cartridge side B is screwed into the second guide or pressed in. The different diameters of the ram tubes in this drawing result from the different dispensing ratios; however, both ram tubes may have the same diameter too.

The same guiding bridge may be used for several dispensing ratios, e.g. from 1:1 to 5:1 or even higher. Only the thrust plates have to be adapted to the actual cartridge diameter. Different dispensing ratios and cartridge diameters require different dispensing forces, which are transmitted independently for each side to the torsion resistant frame via the screw and the screw socket and through rolling friction on the ball or thrust bearing. Therefore, the normally required complicated longitudinal guides of the guiding bridges with their friction, canting, lubrication and sealing problems are no longer needed. A particular advantage is that the driving screws and screw sockets which require a good lubrication because of the high axial forces are totally separated and sealed from the remaining structural units such as drive assemblies, electronics, and from the cartridge space.

Figure 2:
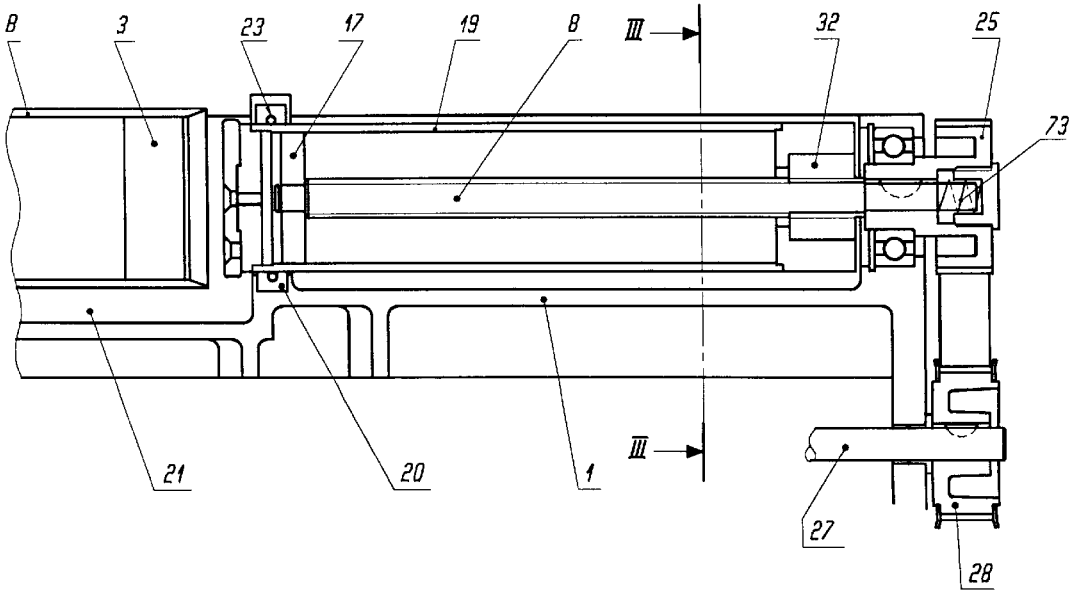
FIG. 2 shows a cross-section according to line II—II in FIG. 1.
Figure 3:
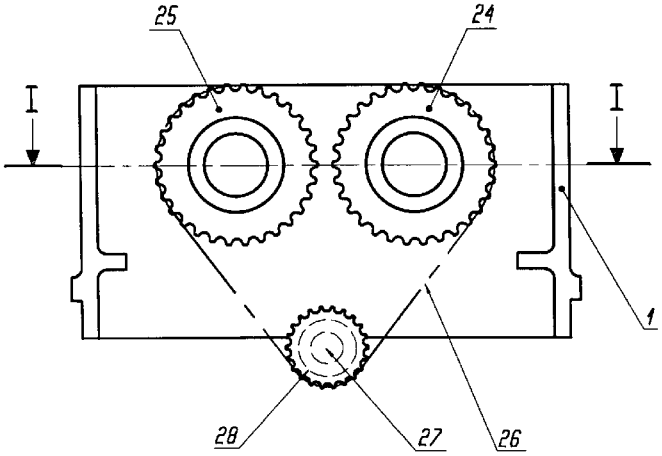
FIG. 3 shows a cross-section according to line III—III in FIG. 2.
Figure 4:
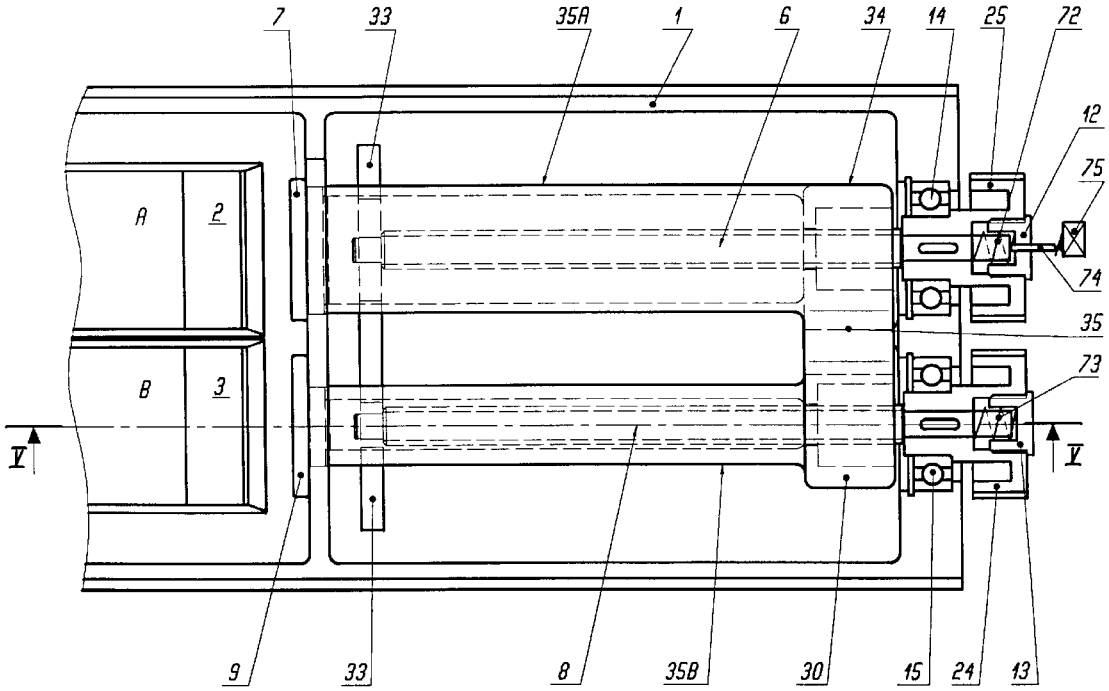
FIG. 4 shows a cross-section of a variant of the embodiment of FIG. 1 according to line IV—IV in FIG. 6.
Figure 5:
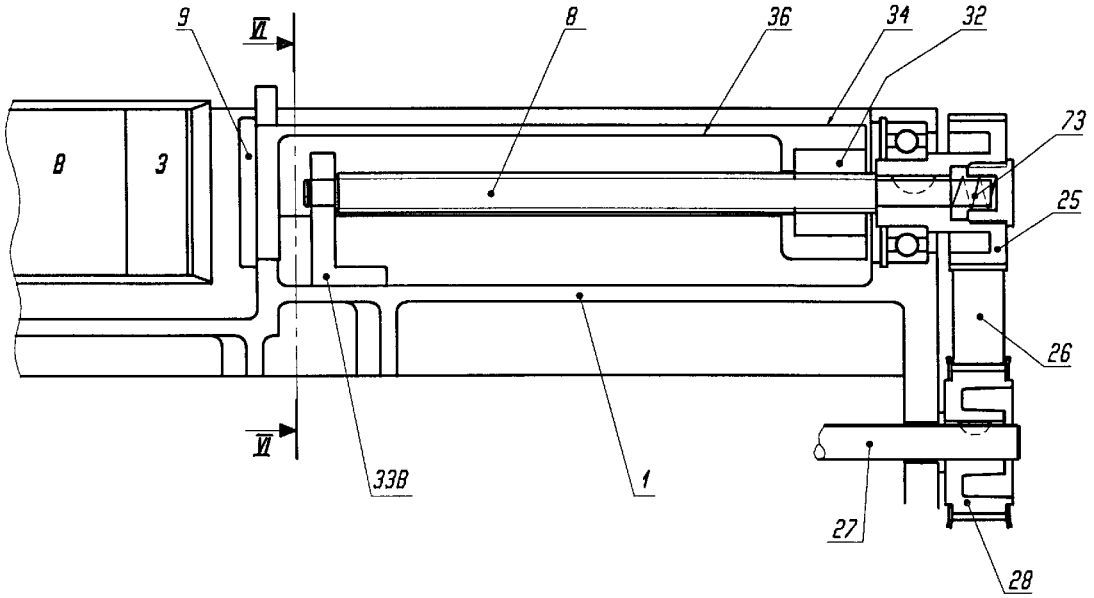
FIG. 5 shows a cross-section according to line V—V in FIG. 4.
Figure 6:
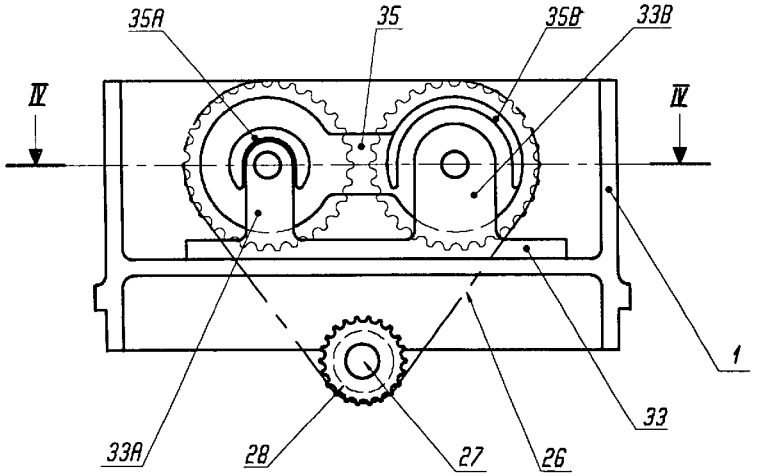
FIG. 6 shows a cross-section according to line VI—VI in FIG. 5.

FIGS. 4 to 6 show an alternative embodiment which is similar to the first embodiment according to FIGS. 1 to 3 and where the same parts are designated by the same reference numerals. In contrast to the first embodiment, the front ends of driving screws 6 and 8 are journalled in bearings 33, 33A and 33B which are directly fastened in frame 1, as appears particularly in FIGS. 5 and 6. Guiding bridge 34 is formed in one piece by connecting bridge 35 with the second guide 30 and thrust pieces 35A and 35B with screwed-on thrust plates 7 and 9. The underside of the guiding bridge resp. of the thrust pieces must be open to allow the passage of bearings 33A and 33B.

Figure 7:
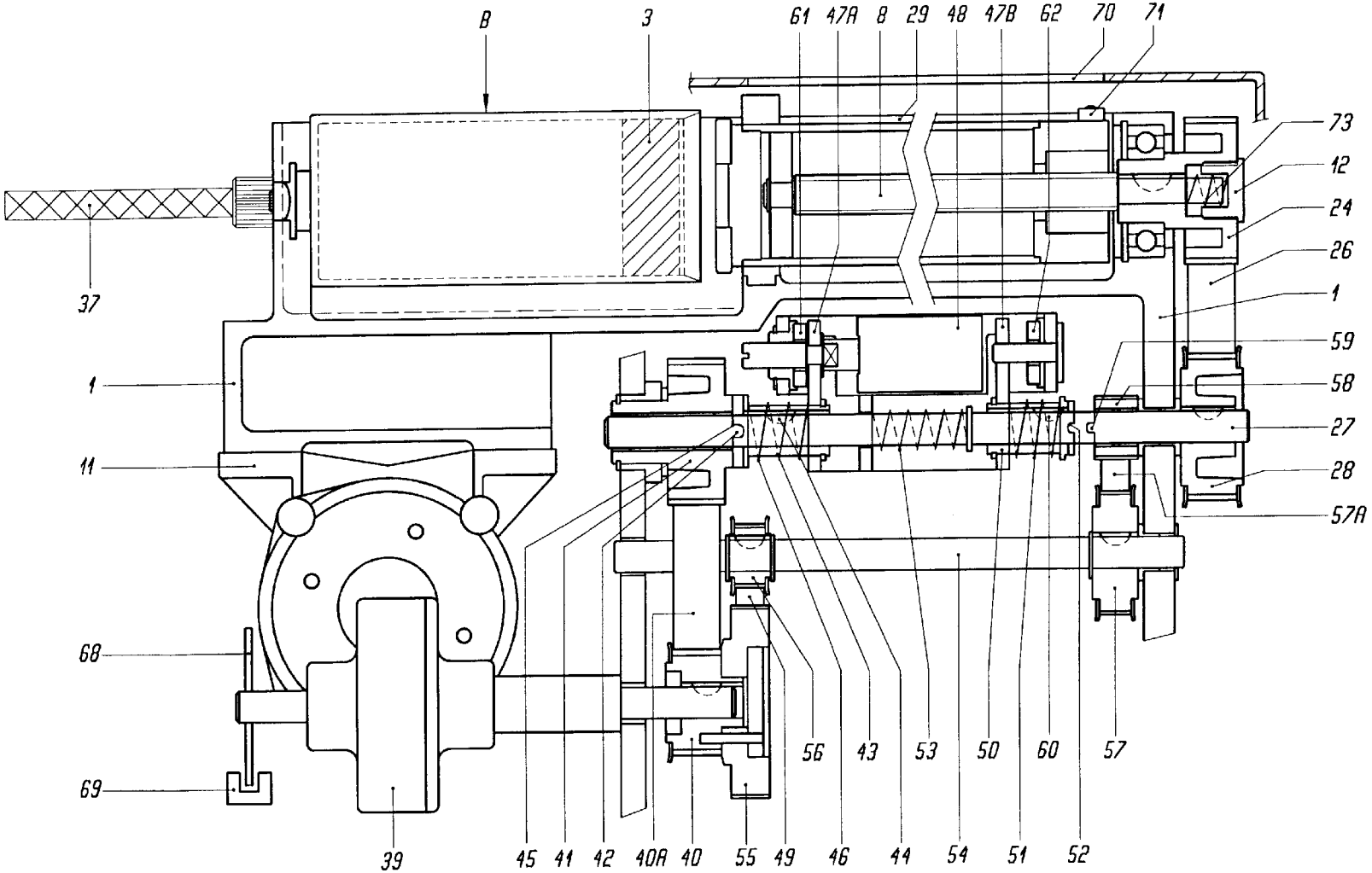
FIG. 7 shows a cross-section according to line VII—VII in FIG. 9 of an embodiment of a dispensing appliance of the invention with the electric drive in a first position.

FIG. 7 shows a schematic sectional view of the entire dispensing appliance of the invention in the dispensing position while the previously described elements of the advance unit are shown, as well as cartridge B with cartridge piston 3 and a mixer 37 attached thereto.

A gear motor M1, flange-mounted to frame 1, drives a worm gear pair 39 which actuates by a first toothed belt wheel 40 and a toothed belt 40A a second toothed belt wheel 41 which is freely rotatable on main shaft 27 and provided with driving cams 42. Next to second toothed belt wheel 41, a shifting sleeve 43 is journalled on main shaft 27 which is radially wedged on the main shaft by a wedge 44 but axially displaceable. In the position of FIG. 7, driving cams 42 of second toothed belt wheel 41 are engaged in corresponding grooves 45 of the shifting sleeve. Alternatively, the driving cams may be provided on the shifting sleeve and engaged in corresponding grooves of the toothed belt wheel. Other connecting elements between the toothed belt wheel and the shifting sleeve are also possible. First shifting sleeve 43 comprises a spring 46.

First shifting sleeve 43 is connected by a first shoulder 47A of coupling slide 47 to an electromagnet 48 the other side of which actuates a second shifting sleeve 50 including spring 51 and grooves 52, journalled on main shaft 27, through a second shoulder 57B of the coupling slide.

In the position of FIG. 7, the electromagnet is deenergized, and a pressure spring 53 actuates coupling slide 47, which in turn presses first shifting sleeve 43 against second toothed belt wheel 41. During the engagement, two conditions are possible: If the grooves and cams coincide, main shaft 27 is driven by wedge 44, and the driving screws and thus also the guide are therefore driven by toothed belt wheels 28 and 24. However, if the grooves and cams do not coincide, first shifting sleeve 43 is only engaged by the pressure of spring 53 when the cams of second toothed belt wheel 41 have reached the position of the grooves of the first shifting sleeve through slowly starting rotation of the toothed belt wheel at a suitable speed. Pressure spring 53 provides a waiting position. After the engagement, shaft 27 is driven by wedge 44.

For the retraction and for fast forward feed, a second driving shaft 54 is provided which is journalled in parallel to main shaft 27 and one end of which is connected via two toothed belt wheels 55 and 56 to motor M1 while the other end is connected by the two toothed belt wheels 57, 58 to the corresponding end of the main shaft. One toothed belt wheel 55 is connected both to first toothed belt wheel 40 and, via toothed belt 49, to the other toothed belt wheel 56 on driving shaft 54. Toothed belt wheel 57 on driving shaft 54 is connected via toothed belt 57A to toothed belt wheel 58 which is provided with cams 59 cooperating with corresponding grooves 52 of second shifting sleeve 50.

Figure 8:
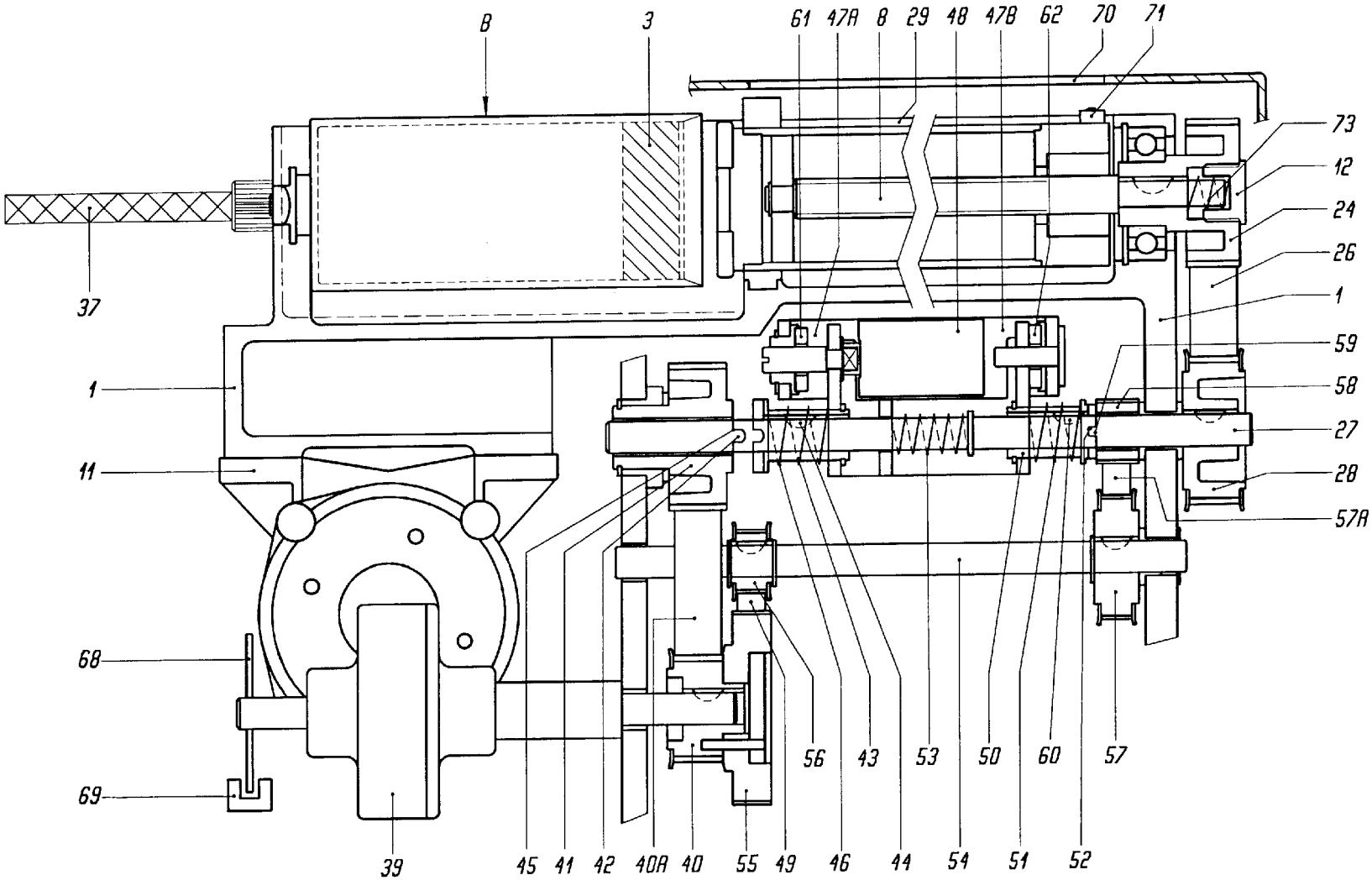
FIG. 8 shows the appliance of FIG. 7 with the electric drive in a second position.

In the position of FIG. 7, i.e. in the engaged position of first shifting sleeve 43, toothed belt wheels 55, 56, 57, 58 as well as driving shaft 54 run along idle and have no driving effect. If the appliance is to be operated in the retraction or fast forward feed mode for a cartridge exchange, electromagnet 48 is energized, its attraction bringing about the coupling position of FIG. 8. The resulting engagement of the second shifting sleeve occurs in the same way as that of first shifting sleeve 43. After the engagement to the right in FIG. 8, on account of the multiplication of the toothed belt gear, main shaft 27 is driven at an increased speed by wedge 60 and second shifting sleeve 50. Toothed belt wheels 40, 41 now run along idle and have no driving effect on driving shaft 54.

When entering into a partly dispensed cartridge, although a fast forward feed is desired, the appliance should automatically switch to dispensing speed as soon as the thrust rods reach the pistons. In the present examples, this is achieved by the fact that the driving screws are supported on support bushings 12 and 13 via respective compression springs 72 and 73, and that one of the driving screws additionally comprises a pin 74 which cooperates with a switch 75. The switch is electrically connected to electromagnet 48.

Accordingly, when the thrust rods hit the pistons during fast forward feed into a partly emptied cartridge, the driving screws are pushed back a little, and pin 74 therefore actuates switch 75 and thus causes the electromagnet to switch from fast forward feed to dispensing speed.

The stroke of magnet 58 is so designed that one of the coupling sides is always completely disengaged before the other coupling side can be engaged. Furthermore, stop buffers 61 and 62 of an elastic material damp the impact noise of coupling slide 47 and of electromagnet 48. It is true that the mechanical construction is more complicated than that of the single coupling in the case of two electric motors according to the mentioned co-pending U.S. Application, but the overall construction is simplified by the absence of the second motor and its control, and the noise of the appliance is reduced due to the absence of the second motor.

Figure 9:
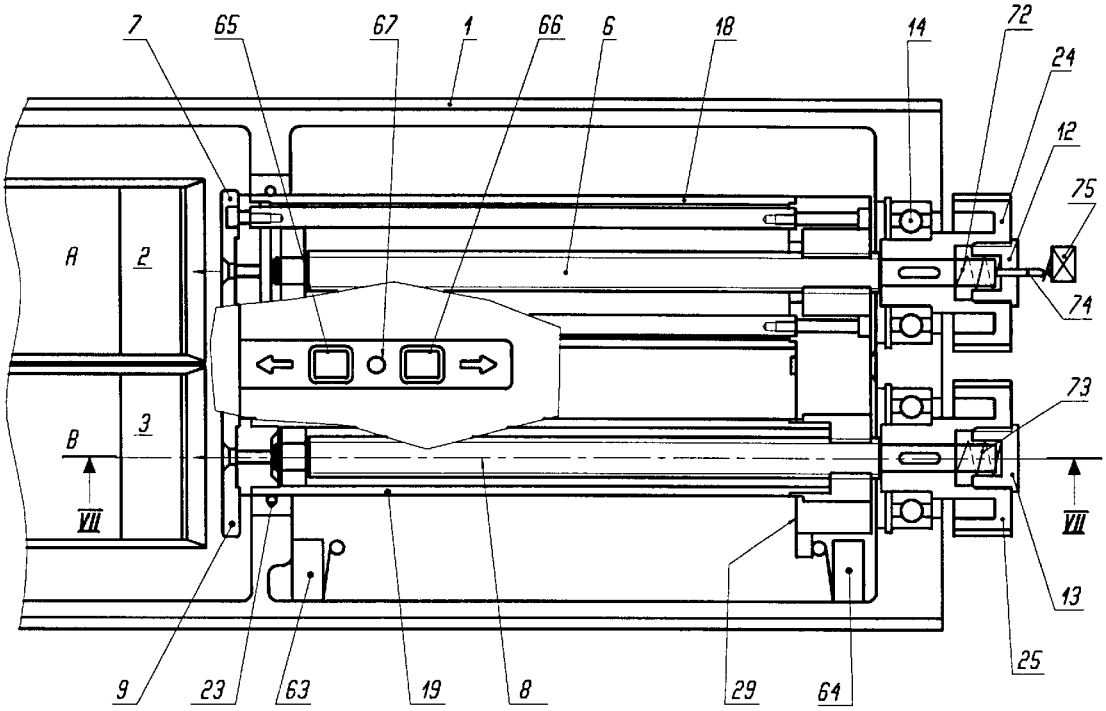
FIG. 9 shows further details of the dispensing appliance of the invention.

Since each advance stroke is automatically followed by a relieving stroke, no cartridge pressure forces act on guiding bridge 29 anymore, so that the fast retraction can be started without resistance. The latter is automatically effected when front switch 63, see FIG. 9, is actuated. This switches on the electromagnet, and main shaft 27 is driven by toothed belt gear 57, 58 while driving screws 6, 8 and thus guiding bridge 29 are driven by means of toothed belt wheels 28, 24 and 25. When the retraction is finished, rear switch 64 is actuated and the electromagnet is deenergized.

Pressure spring 53 then pushes first shifting sleeve 43 against second toothed belt wheel 41, and the engagement is effected as soon as the radial positions of driving cams and grooves coincide, which is the case when gear motor M1 is switched on for a new dispensing operation and rotates at slow speed until the coupling is engaged in order to facilitate the engagement procedure.

For the advance and the start phase of the relieving stroke, e.g. for the first millimeter of the driving screw retraction, high torques at slow speeds are required since the driving screws are still under full load. On the other hand, the retraction and the fast forward feed require higher speeds at small torques.

This distinction, i.e. the separation into a relatively slow drive for high torques and a relatively fast drive for small torques, is achieved by the arrangement of the main and driving shaft according to the invention. Furthermore, this distinction allows to switch off the fast forward feed in the case of an operating error without an overload of the device components, e.g. if it is attempted to start the advance against an obstructed mixer or another hard obstacle.

In addition to the elements already described with reference to FIG. 1, FIG. 9 shows some operating elements. When pressed down, key 65 starts the dispensing operation while releasing this key starts the relieving stroke. In order to keep the duration of the relieving stroke short, during the starting phase, e.g. the first millimeter of the relieving stroke, gear motor M1 is operated at a low speed and a high torque, and during the next 2 to 3 mm, at a higher speed and a correspondingly smaller torque. Actuation of key 53 starts the previously described retraction by means of the mechanical coupling.

Front switch 63 indicates that the cartridge has been completely dispensed and automatically starts the retraction. Rear switch 64 ends the retraction and indicates by indicator lamp 67 that the empty cartridge has to be replaced. A scanner disk 68 and photoelectric barrier 69 (FIGS. 7 and 8) allow different control operations such as switching off the motor in the case of obstacles or hardened materials in the mixer as well as speed monitoring and regulation for different viscosities of the dispensed materials. Furthermore, the electric components and the motor are connected to a correspondingly designed control circuit.

FIG. 7 further shows a filling level indicator having a sight window 70 where a lamp 71 fixed to guiding bridge 29 or 34 is guided along a scale and thereby shows the filling level of the cartridge(s).

As follows from the description, the present electric drive unit for dispensing appliances of multicomponent compositions is so designed that a clear functional separation is established between the advance and the relieving stroke at high torques and low speeds, compared to the fast retraction and the fast forward feed at far smaller torques but substantially higher speeds.

The examples have been described with reference to a drive comprising two driving screws, but the features and advantages of the invention can be applied without major modifications to a drive assembly having a single driving screw with two thrust rods.

Furthermore, instead of the toothed belt wheels or chains, toothed belts can be used for the fast retraction and the fast forward feed, which is quite significant in view of silent appliances.

Although the described electric drive offers particular advantages in the appliance comprising the described advance unit, this drive assembly may also be used in appliances using other advance units or for cartridges having one or several cylinders.

What is claimed is:

1. An electrically operated dispensing appliance in which an electromechanical drive assembly comprises a motor actuating at least one driving screw for a slow advance and a relieving stroke as well as coupling means allowing to switch to fast retraction and fast forward feed, wherein a gear motor is connected to a main shaft by a first gear and a first shifting sleeve in order to operate the advance and the relieving stroke at high loads, whereas for the operation at smaller loads, fast retraction and fast forward feed, said gear motor is connected to the main shaft by a second gear, a driving shaft, and a second shifting sleeve, and wherein an electromagnet is connected to said two shifting sleeves in such a manner that one or the other shifting sleeve is selectively connectable to the main shaft.

2. The dispensing appliance of claim 1, wherein said electromagnet actuates a coupling slide whose shoulders at both ends actuate said shifting sleeves, whereby said gear motor is either directly connected to the main shaft by a toothed belt gear, or the main shaft is connected by a toothed belt gear to a driving shaft, and the latter is connected to said gear motor by another toothed belt gear.

3. The dispensing appliance of claim 1, wherein said first shifting sleeve is under the action of a pressure spring in order to engage grooves on the shifting sleeve with cams on the toothed belt wheel cooperating therewith during slow rotation of said gear motor.

4. The electrically operated dispensing appliance of claim 1, wherein said electromechanical drive assembly actuates an advance unit in which driving screws actuate respective thrust plates in order to dispense the contents of at least one cartridge, the driving screws being arranged in an axially stationary manner and operatively connected to a guiding bridge carrying said thrust plates, the driving screws and advancing elements contained in said guiding bridge being spatially separated and sealed from the cartridge space.

5. The dispensing appliance of claim 4, wherein said driving screws are radially and axially supported by bearing surfaces of support bushings which are journalled in ball or thrust bearings, said driving screws acting upon a second guide of said guiding bridge by means of screw sockets.

6. The dispensing appliance of claim 5, wherein said driving screws are supported on said support bushings via compression springs, and one of said driving screws comprises a pin which cooperates with a switch acting upon the electromagnet in order to switch from fast forward feed to dispensing speed.

7. The dispensing appliance of claim 4, wherein the front ends of said driving screws are journalled on guiding pistons which in turn are journalled in the ram tubes of said guiding bridge, the front ends of said ram tubes being guided by means of a first guide in a frame wall and the rear ends being connected to a second guide, and said guiding bridge being formed by said thrust plates, said ram tubes, and said second guide.

8. The dispensing appliance of claim 4, wherein the front ends of said driving screws are journalled in bearings which are fastened in the frame, and the guiding bridge is formed in one piece by the connecting bridge and the thrust pieces with driving screws screwed-on thrust plates, said thrust pieces comprising a passage for said bearings on their entire length.

9. The dispensing appliance of claim 1, wherein said driving screws are driven by the main shaft at the rear end of the appliance in such a manner that the driving screws are driven synchronously.

10. The dispensing appliance of claim 1, wherein the ratio of the diameters of the cartridges and thus of the thrust plates is equal to 1:1 or different from 1:1.

* * * * *